US005484383A

United States Patent [19]

Fitch, Jr. et al.

[11] Patent Number: 5,484,383

[45] Date of Patent: Jan. 16, 1996

[54] ORBITAL SEPARATOR FOR SEPARATING MORE DENSE AND LESS DENSE COMPONENTS OF A MIXTURE HAVING A CONTROLLABLE DISCHARGE PASSAGEWAY

[75] Inventors: Ernest C. Fitch, Jr.; Ing T. Hong, both of Stillwater, Okla.

[73] Assignee: Bardyne, Inc., Stillwater, Okla.

[21] Appl. No.: 345,077

[22] Filed: Nov. 28, 1994

Related U.S. Application Data

[62] Division of Ser. No. 180,766, Jan. 7, 1994, Pat. No. 5,370,600, which is a continuation of Ser. No. 962,686, Oct. 19, 1992, abandoned, which is a division of Ser. No. 550,375, Jul. 10, 1990, Pat. No. 5,156,586.

[51] Int. Cl.[6] ..... B04B 11/00

[52] U.S. Cl. ..... 494/48; 494/56; 494/67; 494/74

[58] Field of Search ..... 494/2, 40, 43, 494/47, 48, 56, 60, 65, 66, 67, 74, 79, 84, 85, 900; 210/360.1, 371, 377, 380.1

[56] References Cited

U.S. PATENT DOCUMENTS

| | | | |
|---|---|---|---|
| 544,080 | 8/1895 | Bachmann | 494/60 X |
| 622,712 | 4/1899 | Rissmuller | 494/48 |
| 726,948 | 5/1903 | Land | 494/67 |
| 868,288 | 10/1907 | Nilsson et al. | 494/44 X |
| 1,004,760 | 10/1911 | Fetzer | 494/56 X |
| 1,724,254 | 8/1929 | Buckbee | 494/67 X |
| 2,435,665 | 2/1948 | Woolaver | 210/377 |
| 2,563,550 | 8/1951 | Quist | 494/74 X |
| 2,611,693 | 9/1952 | Geyer | 494/56X |
| 2,808,200 | 10/1957 | Wishaw | 494/67 |
| 2,947,472 | 8/1960 | Skarstrom et al. | 494/60 X |
| 3,703,984 | 11/1972 | Pruessner | 494/66 X |
| 4,416,655 | 11/1983 | Bennett | 494/40 |
| 4,626,237 | 12/1986 | Galloway, Jr. | 494/37 |

*Primary Examiner*—David Scherbel
*Assistant Examiner*—Charles E. Cooley
*Attorney, Agent, or Firm*—Head & Johnson

[57] ABSTRACT

An orbital separator for separating denser and lighter components of a mixture employing a separation container having an inlet end and an outlet end. An inlet tube is secured to the separation container inlet end and communicates between the exterior and interior of the separation container. In like manner, an outlet tube is secured to the separation container outlet end and communicates between the exterior and interior of the separation container. The inlet and outlet tubes are coaxial and each are rotationally supported to thereby rotationally support the separation container. Formed in the outlet end of the separation container and surrounding the outlet tube is an annular denser component discharge opening. Positioned externally of the separation container outlet end is a closure member that can be moved towards and away from the discharge opening to thereby vary the area of the discharge opening, so that thereby the performance characteristics of the separator can be varied.

11 Claims, 6 Drawing Sheets

ORBITAL SEPARATOR FOR SEPARATING MORE DENSE AND LESS DENSE COMPONENTS OF A MIXTURE HAVING A CONTROLLABLE DISCHARGE PASSAGEWAY

CROSS-REFERENCE TO RELATED APPLICATIONS

This is a divisional application of application Ser. No. 08/180,766 filed 7 Jan. 1994 entitled "APPARATUS FOR SEPARATING LIGHTER AND HEAVIER COMPONENTS OF A MIXTURE EMPLOYING A REMOVABLE LINER", now U.S. Pat. No. 5,370,600 which was a continuation of application Ser. No. 07/962,686 filed 19 Oct. 1992 entitled "ORBITAL SEPARATOR AND METHOD OF ORBITALLY SEPARATING THE MIXTURE", now abandoned, which was a divisional application of application Ser. No. 07/550,375 filed 10 Jul. 1990 entitled "ORBITAL SEPARATOR AND METHOD OF ORBITALLY SEPARATING A MIXTURE", now U.S. Pat. No. 5,156,586.

BACKGROUND OF THE INVENTION

This invention relates to rotational devices for separating components of a mixture, such as centrifuges.

A separator, by definition, isolates and classifies substances of all types: gases, liquids and solids-according to their physical properties. Various types of separator mechanisms exist including inertial and centrifugal. An inertial separator is a kinetic device that exhibits cyclonic behavior by hydraulically accelerating the mixture to be separated in a circular path and uses the radial acceleration to isolate the components of the mixture. For example, in a hydrocyclone, fluid enters circumferentially at the top and the purified fluid migrates toward the center and out the central tube at the top while the separated denser material tends to stay near the outside wall where it proceeds downward to the underflow port. Separation occurs in a free vortex region.

A centrifugal separator is a kinematic device that achieves separation due to the centrifugal force created by the mechanical rotation of the system. In a conventional centrifuge, fluid normally enters at the center of a whirling mass then is pressed toward the outside by centrifugal force. More dense materials move toward the outside while less dense materials remain on the inside.

One of the problems with commercially available centrifugal separators or centrifuges is that a gradient flow exists to perpetuate eddy currents that cause turbulent mixing of the components of the mixture. This is one of the main reasons why many circulating centrifuges exhibit poor separation efficiencies. The ultra-high rotational speed required to achieve micronic separation of components is evidence of the inefficiency exhibited by commercially available centrifuges.

The residence time provided by conventional centrifuges for components to be separated and to exit the circulating stream is recognized as another serious drawback in current designs. One of the reasons for this inadequacy is that the mixture is introduced near the center of rotation axially where the denser components must travel through the circulating layers of the mixture before they can reach the more stagnant, high energy orbital area near the periphery of the separation chamber-this assumes that a true stagnation zone actually exists in the first place.

Another characteristic of commercial centrifuges is that the less dense components of the mixture are forced to exit near the collection zone for the more dense components or to make abrupt turns at critical points within the system. In many cases, eddy currents are active and there is little control over recontamination of the separated components of the mixtures.

SUMMARY OF THE INVENTION

This invention provides an orbital separator for separating denser and lighter components of a mixer, such as for separating oil and water or solid components suspended in a liquid. The separator has a housing. Rotatably positioned within the housing is a cylindrical separation container. One end of the separation container is an inlet end and the opposite end an outlet end. An inlet tube is affixed to and extends from the separation container inlet end. The inlet tube provides communication between the interior and exterior of the separation container and serves as an inlet through which the mixture to be separated is passed into the separation container.

Secured to the outlet end of the separation container is an outlet tube which is rotatably supported by the housing. The outlet tube communicates with and extends externally of the separation container and serves as an outlet passageway for separated lighter component of the mixture.

Formed in the separation container outlet end is an annular discharge passageway through which heavier components separated from the mixture pass.

Positioned on the exterior of the outlet tube and below and adjacent the separation container discharge end is a closure member. The closure member is configured to open and close the area of the discharge passageway. In the preferred and illustrated embodiment the closure member is non-rotatably supported on the exterior of the outlet tube and, by means of a lever extending exteriorly of the housing and a yoke connected to the closure member the spacing between the closure member and the separation container outlet end can be varied to thereby vary the area of the discharge opening.

A pulley is secured to the outlet tube within the housing and by means of a belt which may be driven by a motor or the like, the outlet tube is rotated, thereby rotating the separation container.

The separation container preferably includes a plurality of spaced apart radial fins which impart rotary motion to the incoming mixture to cause the heavier component to migrate outwardly and the lighter component to migrate inwardly, the lighter component passing out through the outlet tube and the heavier component passing out of the separation container through the variable discharge opening.

DETAILED DESCRIPTION OF THE DRAWING

DETAILED DESCRIPTION OF PREFERRED EMBODIMENT

Figure 1:
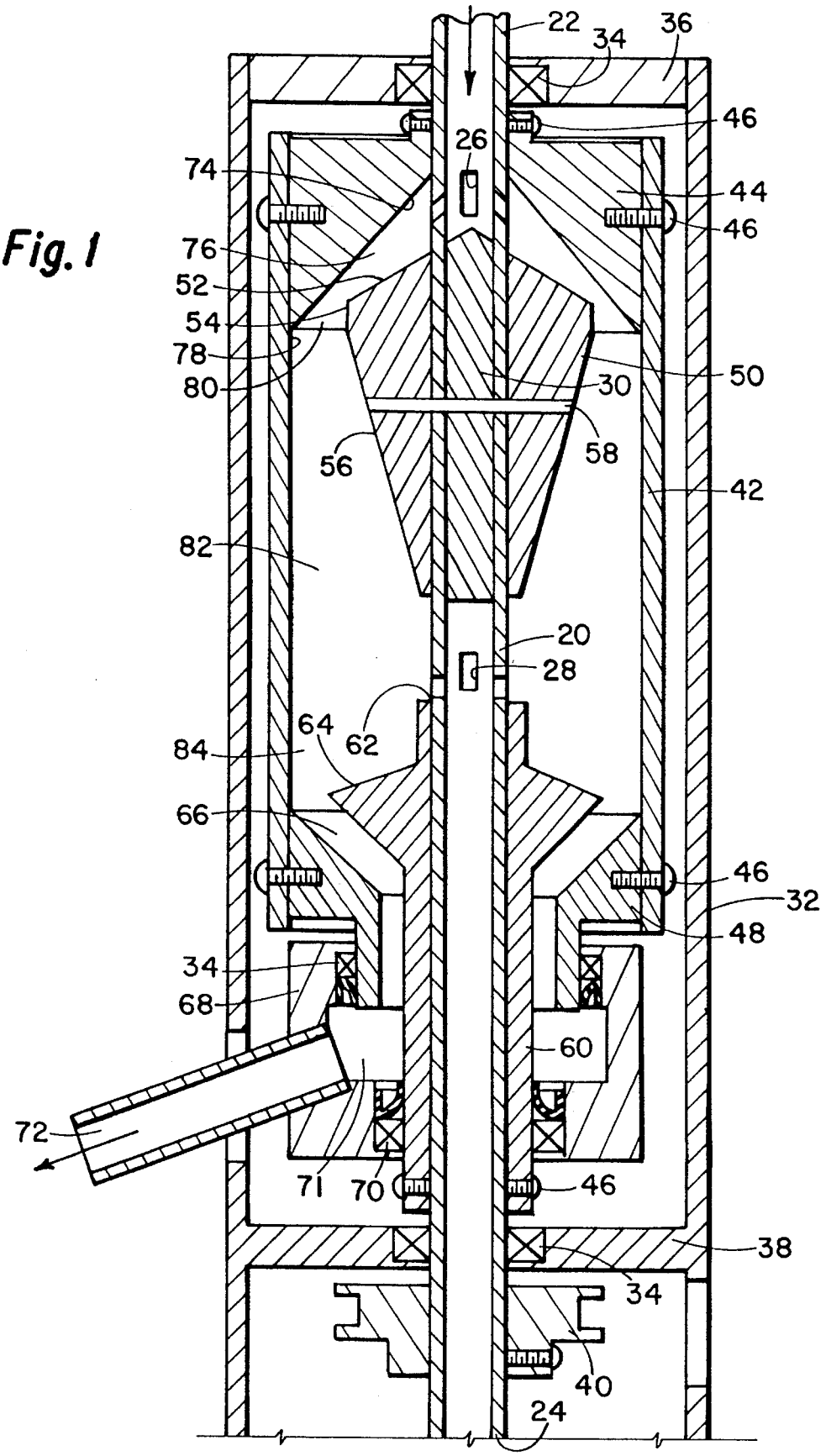
FIG. 1 is a longitudinal cross-sectional cut away view of the orbital separator device of the preferred embodiment of this invention for separating the components of a mixture.

The preferred embodiment is illustrated in FIG. 1. Structurally, this includes of an axial tube 20 which has an inlet end 22, a discharge end 24, inlet pods 26, discharge ports 28, and luminal plug 30. The tube may be formed of any suitable material, such as metal, plastic or the like. A means of controlling flow rates (not illustrated), such as a valve, spigot, or the like, may be attached at either, or both, the inlet end 22 and the discharge end 24.

The tube 20 is centrally, and axially, mounted in a housing 32 having a top plate 36 and a bottom plate 38. The tube 20 extends through top plate 36 and bottom plate 38 and is supported therein by bearings 34 at the top plate and bottom plate so as to allow rotation of tube 20 within housing 32. The tube 20, near its discharge end 24 has an attached pulley 40 for supporting a belt (not illustrated) to rotate tube 20. Other means of rotation may be used, such as a hollow shaft motor, hydraulic means, pneumatic means, and the like.

The housing 32 may be made of any suitable material such as metal, plastic and 15 the like. The device may operate without a housing. Between housing 32 and tube 20, a separation container 42 is supported from tube 20 such that rotation of tube 20 rotates the container 42. Container 42 is placed so that tube 20 is axially located in container 42. This container 42 may be made of metal, plastic, or other suitable material. In this embodiment, the container 42 is cylindrical, however, other shapes such as tear-drop, ovoid, spherical and the like are also functional.

The container 42 has a top member 44 which is retained within container 42 by screws 46, or other means. This top member 44 is annular in shape and closes the space between tube 20 and the inner wall of the container 42.

The container 42 has a bottom member 48 which is also retained within the container 42 by screws 46, or other means. This bottom member is annular in shape and partially closes the space between tube 20 and the inner wall of container 42 and is located at the opposite end of container 42 from top member 44. Both the top member 44 and the bottom member 48 may be formed of metal, plastic, or other suitable material and may be manufactured by turning on a lathe, casting or by other suitable means.

A flow directing member 50 is mounted on tube 20 within separation container 42. This flow directing member 50 is composed of a shroud 52, an apron 54, and a skirt 56. This flow directing member 50 is mounted on tube 20 by means of a pin 58, or other suitable mounting means, which also holds luminal plug 30 within tube 20. Thus, rotation of tube 20 rotates flow directing member 50. The flow directing member 50 may be formed of metal, plastic or other suitable material; may be solid or hollow; and has an axial lumen through which tube 20 is inserted.

A sleeve 60 encircles the lower end of tube 20 and is fastened thereto by screws 46, or other suitable means so that it too rotates with tube 20. The upper portion of sleeve 60 begins immediately below the discharge ports 28 of tube 20 and forms a flat mesa 62. The sleeve 60 then extends downward to an outward flare forming a shelf 64. The sleeve is annular in outline and continues down the tube 20 through the bottom member 48 and continuing down to end near the bottom plate 38 of housing 32.

Where the sleeve 60 passes through the bottom member 48 an annular passage 66 is formed through which materials may be discharged from the separation container 42. The inner wall of this passage 66 is formed by sleeve 60, and the outer wall by the bottom member 48.

A discharge receptacle 68 is mounted below the separation container 42 and surrounds tube 20, lower portion of sleeve 60, and the lower portion of the bottom member 48. The receptacle 68 is supported (not rotatable) by bearings 70 on the sleeve and by bearings 34 on the bottom member 48. Thus, the annular passage 66 enters the discharge receptacle 68 which has a space 71 which then exits via an exit pipe 72. The exit pipe 72 may have a means of regulating flow (not shown) on it, such as a valve, spigot, or the like.

Within the separation container 42, a series of spaces are defined by the various structural elements. Between the inner surface 74 of top member 44 and shroud 52 a generally wedge-shaped space is formed, termed the induction chamber 76. In continuity with this space, and defined by the wall of separation chamber 78 and apron 54 is an area called the injection channel 80. The size of the injection channel may be varied by an aperture ring (not shown) at the periphery of shroud 52 or apron 54. The area within the separation container 42 below injection channel 80 and above the mesa 62 is called the separation chamber 82. The contiguous space below mesa 62 and ending at shelf 64 and peripheral passage 66 is called the moat 84.

We will now describe the operation of the embodiment of FIG. 1 just described.

Rotation is provided by pulley 40 connected by a belt, not shown, to a motor or other motive means. This causes tube 20, separation container 42, top member 44, flow directing member 50, bottom member 48 and sleeve 60 to rotate together. A flow of a mixture with components to be separated is then fed into inlet tube 22. This mixture may be any combination of gases, liquids and solids. The mixture then passes down rotating tube 20 to inlet pods 26 and then into induction chamber 76. Rotational energy is imparted to the mixture by the rotating tube 20 and by being forced radially outward by shroud 52 from the inlet pods 26. The induction chamber 76 is generally wedge-shaped. The outlet of the induction chamber 76, at the beginning or top of the injection channel 80, should have a flow area equal to, or less than, the flow area of the inlet ports 26, to prevent flow starvation.

The mixture density, rotational speed, radial position and elevation establish each point on the isobar 92 paraboloid. The simultaneous solution of the equation for the critical orbital position and the equation for the associated critical isobar yields the pressure level that exists at a specific injection channel position. This is the pressure needed to inject the mixture flow from the induction chamber area into the separation chamber at an orbital position needed to assure separation of the desired size/density component.

Figure 6:
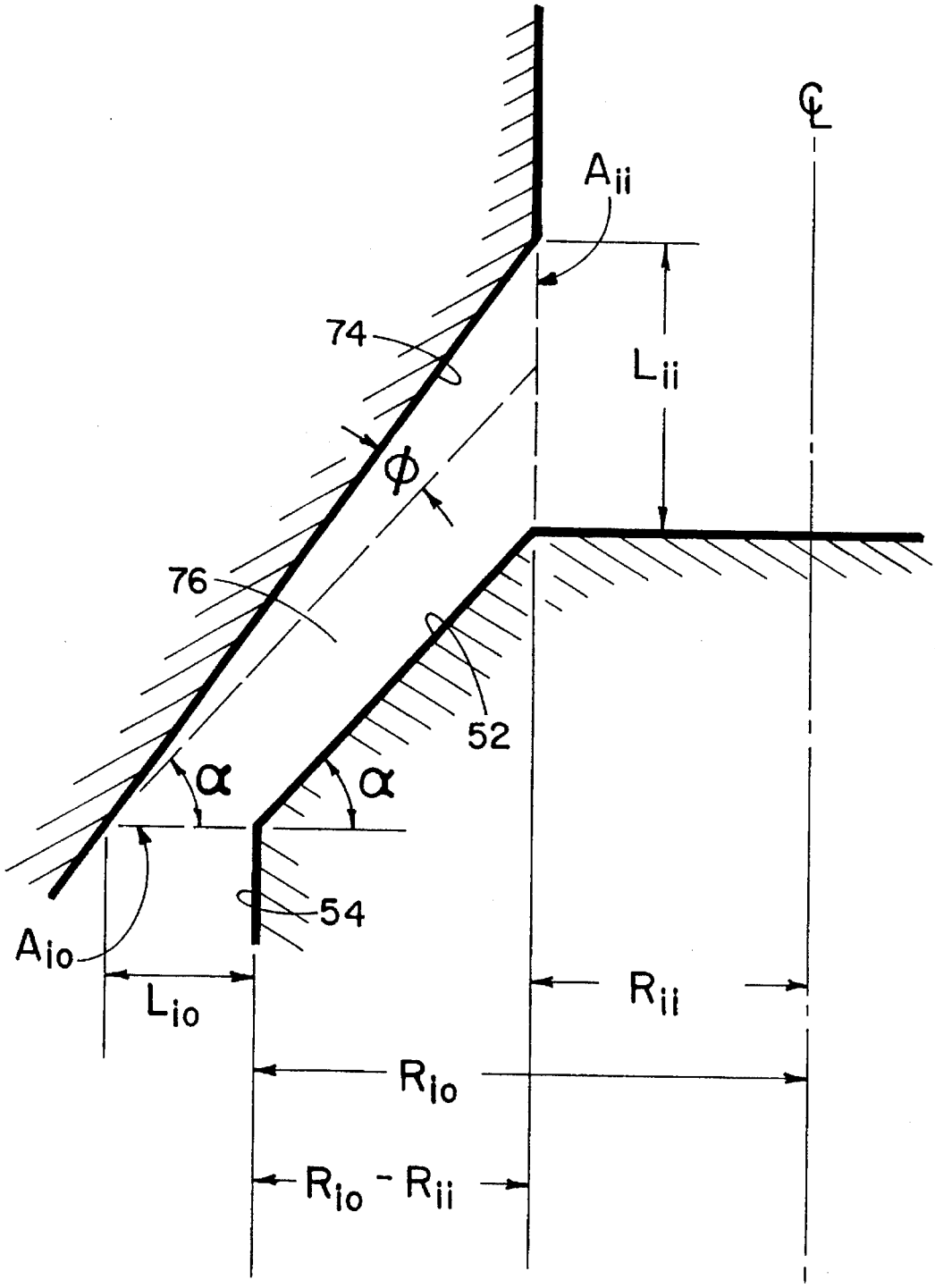
FIG. 6 is a detailed cross-section of the induction chamber.

The induction chamber 76 is generally wedge-shaped as shown in detail in FIG. 6. The wedge angle θ (Theta) is important in maintaining a constant mass flow rate through the induction chamber 76. To accomplish this, the flow area at the wedge outlet $A_{io}$ must be less than or equal to the flow inlet area $A_{ii}$. Under critical design conditions (with no flow saturation or over pressurization), the following relationships should hold:

$$\theta = \text{tangent}^{-1}\left[\frac{L_{ii} + (R_{io} - R_{ii})\tan\alpha}{(R_{io} - R_{ii} + L_{io})}\right] - \alpha$$

Where:

$\theta$ = The wedge angle of the induction chamber
$\alpha$ = The shroud angle
$A_{ii}$ = Flow inlet area
$A_{io}$ = Wedge outlet area
$R_{ii}$ = The minor radius of the shroud
$R_{io}$ = The major radius of the shroud
$L_{ii}$ = Inlet flow clearance
$L_{io}$ = Outlet flow regulation clearance, and $$L_{io} = -R_{io} + \sqrt{R_{io}^2 + 2L_{ii}R_{ii}}$$

Figure 2:
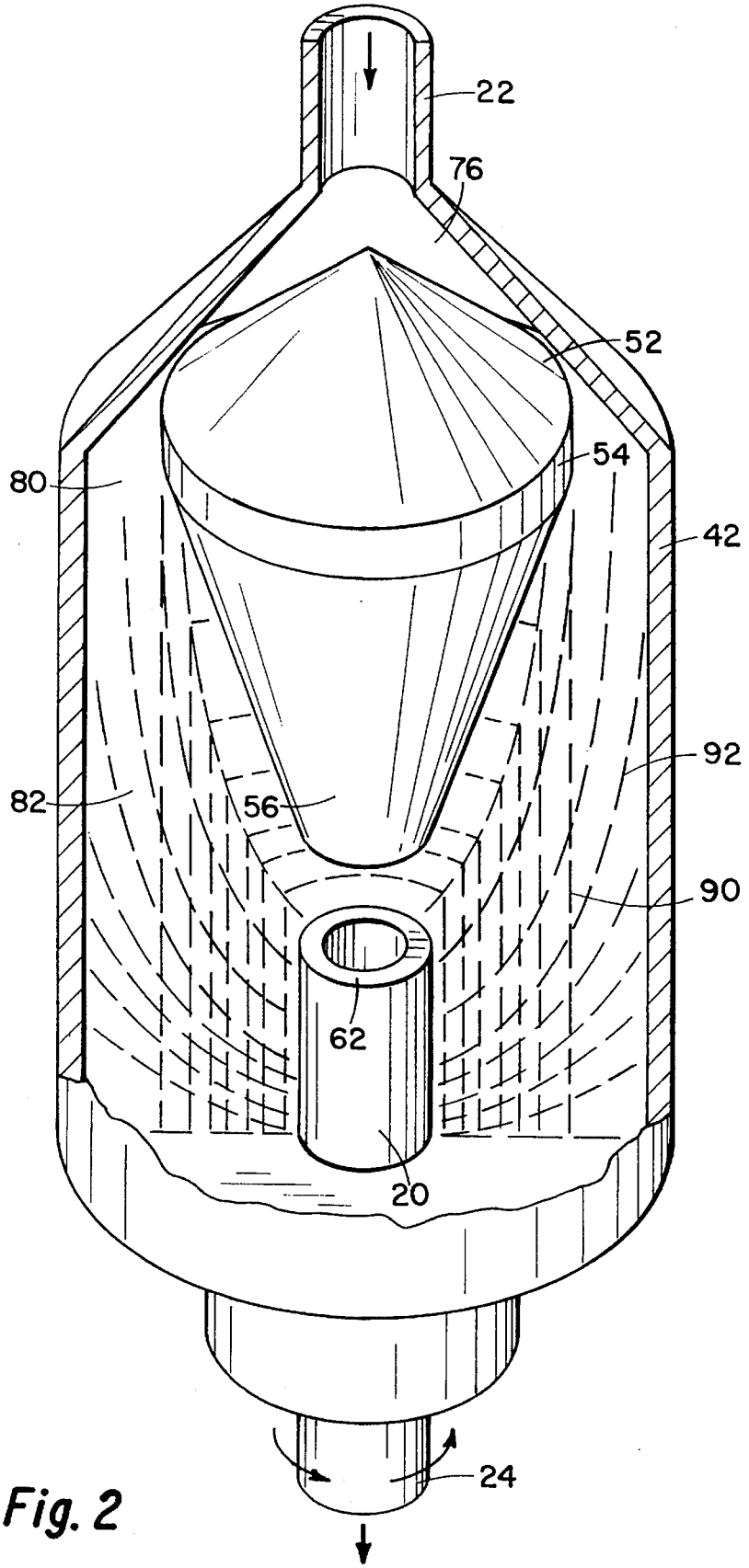
FIG. 2 is a diagrammatical view showing the flow pattern within the separation container.

From the induction chamber 76 the mixture then enters the injection channel 80 and then into the separation chamber 82. It is helpful, at this point, to refer to FIG. 2, which is a non-mechanical drawing of the device showing orbits of constant energy 90. The more peripheral orbits have higher energy than do rear axial orbits. The mixture is injected into high energy orbit in the separation container 42. Thus, the more dense components of the mixture are already in the high energy orbits necessary to effect separation—in contrast to the usual centrifugal separator where the more dense components must "fight" their way to the peripheral high energy orbits. The less dense components at the periphery follow the isobaric paraboloids 92 (lines of pressures) inwardly and exit at the mesa 62.

Referring again to FIG. 1, the skirt 56 of the flow directing member 50 maintains the peripheral orientation of the mixture in the upper portion of separation chamber 82 and allows gradual inward movement of the less dense components of the mixture as skirt 56 tapers toward mesa 62. This prevents "sneak flow" of mixture to the axial area beneath apron 54 thus preventing contamination, and this configuration further prevents cavitation and vacuum formation axially.

As flow continues down separation chamber 82 the less dense components migrate axially and are discharged via discharge ports 28 into the lumen of the tube 20 and thence out the discharge tube 24. A means of controlling the flow in the discharge tube 24 may be incorporated (not shown).

The more dense components remain peripherally and enter moat 84 and from there may be discharged via a peripheral passage 66 into the space 71 in the discharge receptacle 68, and out the exit pipe 72. Discharge may be continuous or periodic. Flow may be controlled in exit pipe 72 by a valve, spigot or other flow controlling means.

In the embodiment of FIG. 1, when the member 64 is fully downwardly positioned, passageway 66 is fully closed. Thus, the discharge passageway 66 may be varied from fully open (as shown in FIG. 1) to fully closed to thereby permit the operator to adjust the rate of discharge of the heavy component of the mixture. While not shown in FIG. 1, a yoke may be provided for raising and lowering the shelf member 64 from means external of housing 32.

It is well to point out that the flow pattern exhibited within the separation chamber is one of the unique features of this invention. The following is our perception of the operational features of our invention and reference to FIG. 2 may be helpful for a full understanding of the invention. The mixture flow enters the chamber at the top and periphery with a uniform rotational velocity causing solid body rotation. The mixture possesses a two dimensional vector having a slight radially inward component as well as a strong downward directional component. Since horizontal frictionless flow occurs in the separation chamber, the isobars 92 should represent areas where acceleration is everywhere equal to zero. The resulting flow is such that the centripetal acceleration exactly balances the horizontal pressure force. In addition, the inertial flow, which is the flow that occurs in the absence of external forces, causes the high density components to move to the exit port 66.

By varying the speed of rotation, the pressure needed to inject a mixture flow into the chamber 76 and centrifugal force can be changed. This will also change the slope of isobaric paraboloids 92. This slope can be made essentially vertical which will result in minimal drag force and maximum separation force.

The rotation of the separation chamber 82 produces concentric energy orbits 90 about the axis of rotation. These orbits 90 are constant energy orbits for the components of the mixture being separated. The greater the distance a given orbit is from the center axis, the greater its energy level and the greater its separation potential.

A particle in orbit about the central axis is forced outwardly by centrifugal force and inwardly by centripetal force created by the drag of the mixture components moving centrally. If the particle is in low energy orbit, the drag force of the mixture may exceed the centripetal force and cause the particle to move axially to the exit. If the centrifugal and centripetal forces balance, then the particle will remain in orbit and gravity will cause the particle to descend to the moat area where it can be separated peripherally. When centrifugal force exceeds centripetal force on the particle, it is moved toward the outer periphery of the separation chamber 82. The movement of the particle, as described above, depends on particle size/density and the viscosity/density of the other components of the mixture. The final position of the particle in the various orbits is its equilibrium orbit where centrifugal and centripetal forces are equal.

When a given particle size/density separation is to be achieved, it is important that the mixture be injected into an orbit of greater energy than the equilibrium orbit, to achieve optimum separation. This may be achieved by varying rotational speed, diameter of the chamber, force of injection and the like.

One use of the device of this disclosure relates to fluid-fluid separation, such as oil in water. When the host fluid (water) enters the moat area 84, it is extracted continuously (for example, by an overflow sump) and the contaminated oil-water moves to the mesa area 62 discharge port 28. By using a properly dimensioned aperture 26 and shroud 52 the oil component will enter the separation chamber 82 and ride in on the inner paraboloidal envelop 92 of the water. The water in the inlet fluid will immediately join and displace the water in the paraboloid while the oil, which is not at a high enough orbital energy to penetrate the water, escapes. This means that trace amounts of oil can be removed from bulk water.

Another application of the invention is fluid-solid separation as in mineral/ore separations. In this, the ore is pulverized and placed in a liquid carrier for separation in the device. If a dense fluid is used (one heavier than the component of the ore to be extracted) the ore component will be discharged axially 28. If a lighter fluid is used, the ore component will be discharged peripherally 66.

Figure 4:
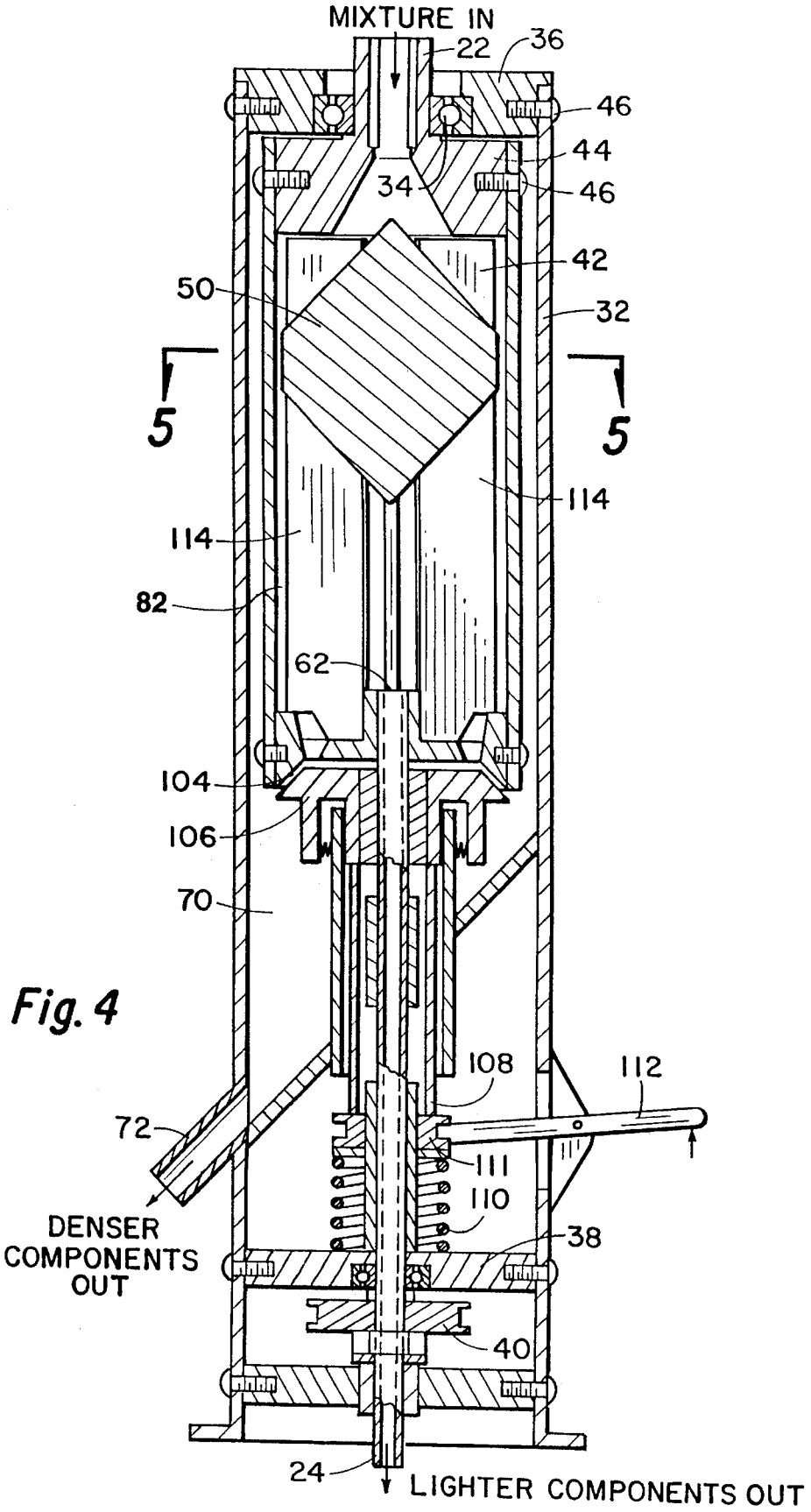
FIG. 4 is a longitudinal cross-sectional cut away view of still another alternate embodiment showing a non-continuous central tube and showing a discharge passage dosing means utilizing a lever and springs and radial fins.

An example of gas-liquid-solid separation would be separation employing the embodiment of FIG. 4 of the components of smog. Radial fins 114 are used to maintain solid body rotation in gaseous separations. The solids and water droplets are separated through passageway 104, while the gas (air) is vented through the axial opening 62. The device can also be used to degas liquids (gas-liquid) separation.

Other possible uses of this device would include, but are not limited to, separation of milk components (liquid-liquid separation or liquid-solid separation), separation of blood components (plasmapheresis, etc.), water purification (removal of bacteria and particulate matter), removal of contaminants in smoke emissions (smokestack scrubber), and the like.

Figure 3:
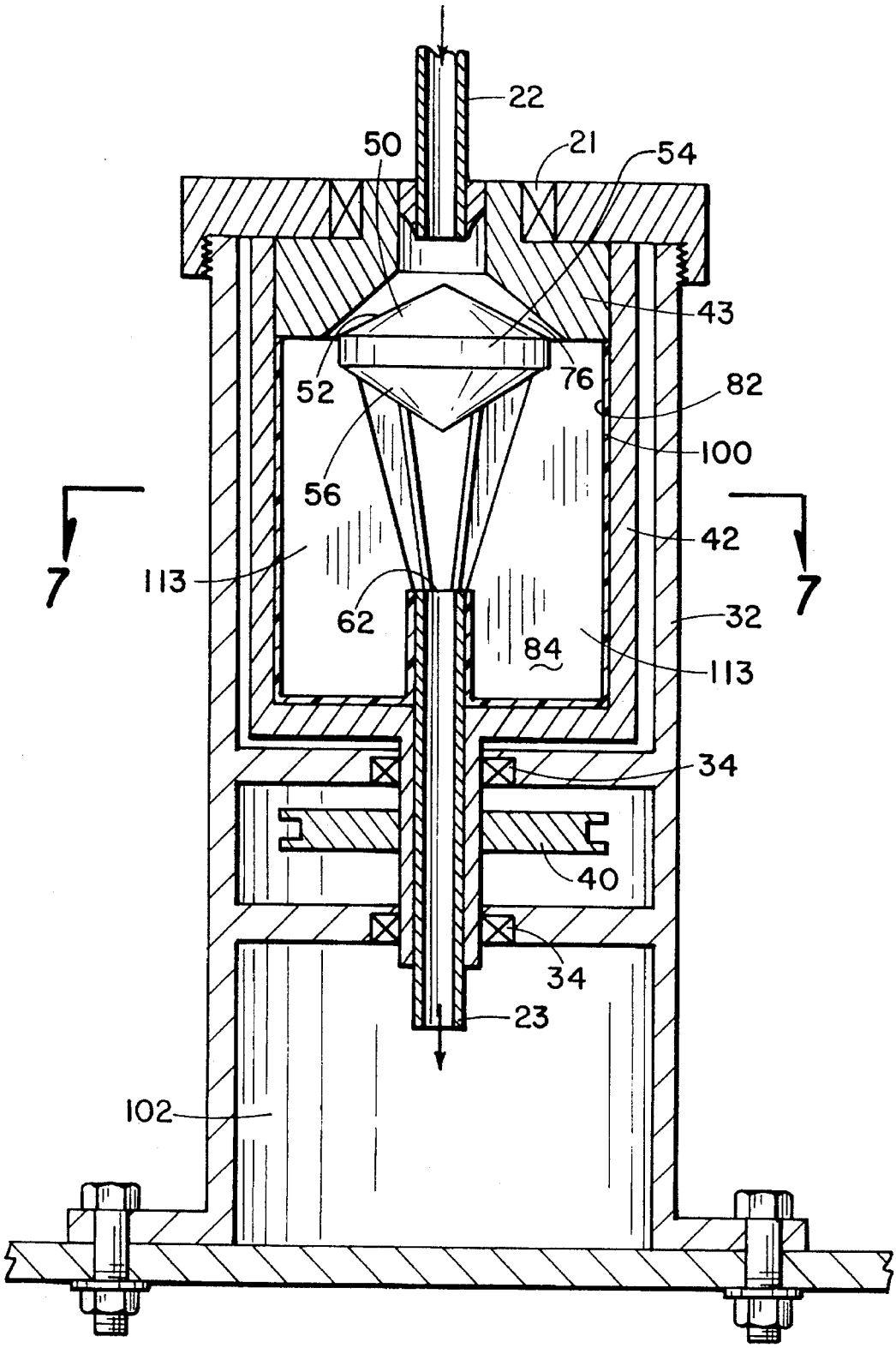
FIG. 3 is a longitudinal cross-sectional cut away view of an alternate embodiment showing a non-continuous tube, a liner contained within the separation chamber and a collection chamber for the less dense components.
Figure 7:
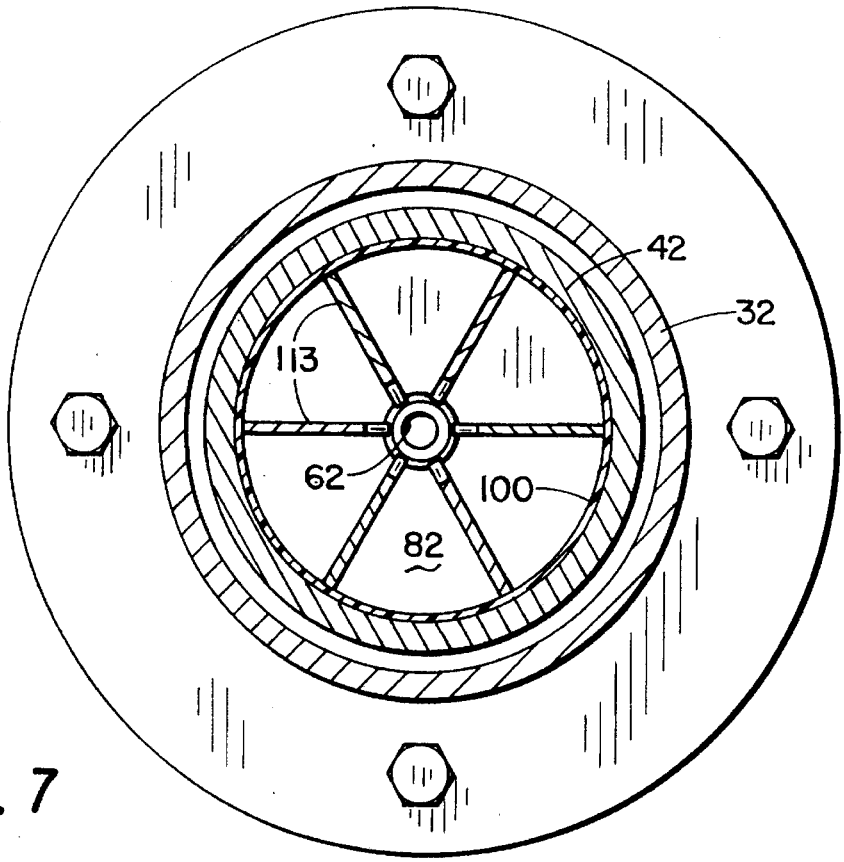
FIG. 7 is a cross-sectional view taken along the line 7—7 of FIG. 3.

Other embodiments of the invention have been tried and found to be workable. FIG. 3 illustrates an embodiment in which there is no outlet for the more dense components. The more dense components settle in the separator chamber 82 downwardly into the moat 84 and are removed after separation by removing the liner 100 which is contained within the separation container 42. This liner may be plastic, or other suitable material. The less dense components of the mixture are discharged through an axial discharge tube 23 into a collection chamber 102 which may be drained continuously, or periodically. The inlet tube 22 empties into and ends at the induction chamber 76. Flow director 50 is supported by radial fins 113, as shown best in FIG. 7. Tube 23 is rotatably supported by bearings 34 from the housing and top member 43 is supported by bearings 21 from the housing. Rotating pulley 40 rotates in unison with tubes 22 and 23, separation container 42, and fins 113 which support flow director 50. Top member 43 and liner 100 are also rotated.

While the embodiment of FIG. 3 does not provide an outlet for the separated heavier component, such outlet may be of a type which is in the form of an opening concentric with inlet tube 22.

Figure 5:
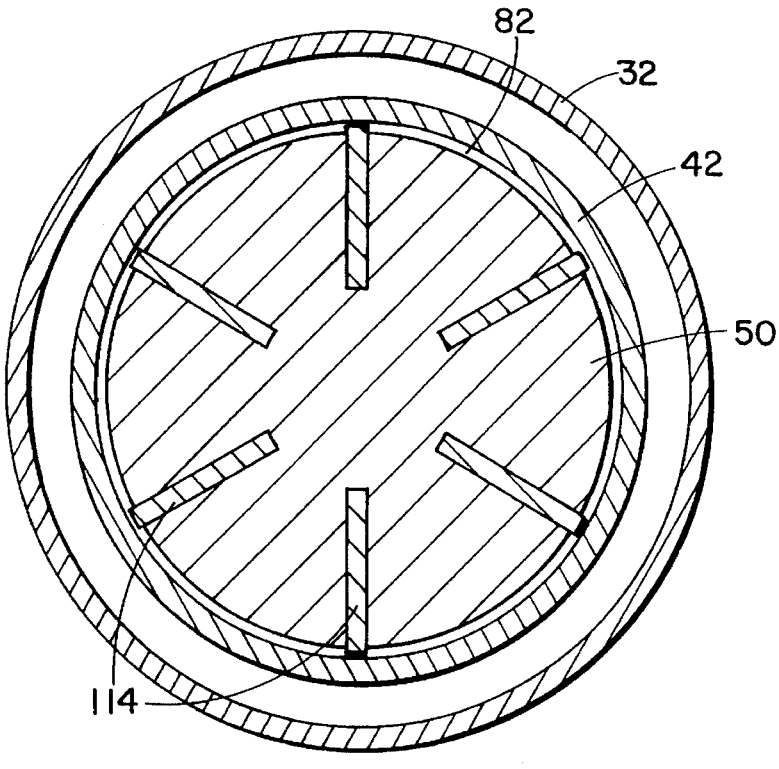
FIG. 5 is a cross-sectional view of FIG. 4 at the line 5—5.

Another embodiment, that has proven useful, is shown in FIG. 4. As in FIG. 3, the central axial tube 20 (in FIG. 1) is not continuous. The heavier, more dense components of the mixture again are discharged peripherally through a discharge passage 104 which empties into a space 70 and thence out an exit pipe 72, much like the embodiment in FIG. 1. However, the discharge passage 104 is variable, and is normally in a closed position. This is accomplished by a closing member 106 which is urged upward closing the passage 106 by a sleeve 108 which is kept in the upward position by a spring 110. Yoke 111 is positioned between the spring 110 and the sleeve 108. By pushing downward on the yoke 111, compressing spring 110 by means of the lever 112, the sleeve 108 drops and allows the closing member 106 to move downward and open the discharge passage 104. A further feature in FIG. 4 is a series of radial fins 114 which extend from the flow directing member 50 to the wall of the separation container 42. The fins 114 thus divide the separation chamber 82 into a series of wedge-shaped spaces, as shown in the cross-section of FIG. 5.

The fins 114 may be included in any of the embodiments. The fins 114, by compartmentalizing the separation chamber 82, promote solid body rotation of the mixture and enhance separation.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An orbital separator device for separating more denser and less dense components of a mixture, comprising:

a separation container having an inlet end and an outlet end;

an inlet tube secured to said separation container inlet end and communicating with said separation container by which said mixture is introduced into said separation container;

a rotational outlet tube secured to said separation container outlet end and communicating with said separation container, said inlet and outlet tubes being coaxial with each other, said outlet tube providing a path for the flow of a less dense component of said mixture out of said separation container;

means of applying rotational energy to said separation container whereby said separation container is rotated about an axis that is coaxial with said inlet and outlet tubes;

a denser component discharge opening adjacent said separation container outlet end;

an annular closure member coaxially and slideably received on said outlet tube and positioned adjacent said discharge opening; and means to selectably position said closure member relative to said discharge opening to thereby vary the area of said discharge opening.

2. The device, as described in claim 1, including a housing and with said separation container axially and rotatably mounted within said housing.

3. The device, as described in claim 1, wherein said discharge passageway comprises at least one circumferential exit opening at the lower portion of said separation container for removing the more dense components of said mixture.

4. The device, as described in claim 1, wherein said separation container is compartmentalized by at least one radial fin.

5. An orbital separator according to claim 1 including a housing, said inlet and outlet tubes being rotationally supported by said housing to thereby rotationally support said separation container within said housing.

6. The device, as described in claim 5 including an axially mounted member within said separation chamber which directs said denser components of said flow towards the periphery of said separation container.

7. The device, as described in claim 6, wherein said separation container has at least one radial fin within the space between said axially mounted member and said separation container.

8. An orbital separator according to claim 5 wherein said closure member is supported by said housing and is positionable towards and away from said discharge opening by means controllable exteriorally of said housing.

9. An orbital separator device according to claim 1 wherein said closure member is rotationally stationary.

10. An orbital separator according to claim 1 including at least one fin member positioned within and rotated with said separation container.

11. An orbital separator device according to claim 1 wherein said discharge opening is substantially annular and surrounds said outlet tube.

* * * * *